US009074837B2

(12) United States Patent
Bednar et al.

(10) Patent No.: US 9,074,837 B2
(45) Date of Patent: Jul. 7, 2015

(54) METHOD AND APPARATUS FOR ALIGNING ARROW NOCKS

(71) Applicant: Hunter's Manufacturing Company, Inc., Suffield, OH (US)

(72) Inventors: Richard L. Bednar, Munroe Falls, OH (US); Michael J. Shaffer, Mogadore, OH (US); Jacob A. Hout, Akron, OH (US); Dean Mook, Suffield, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 43 days.

(21) Appl. No.: 14/075,244

(22) Filed: Nov. 8, 2013

(65) Prior Publication Data

US 2015/0018140 A1 Jan. 15, 2015

Related U.S. Application Data

(60) Provisional application No. 61/846,141, filed on Jul. 15, 2013.

(51) Int. Cl.

| | |
|---|---|
| ***F42B 6/06*** | (2006.01) |
| ***F41B 5/14*** | (2006.01) |
| ***F42B 12/42*** | (2006.01) |
| ***F42B 12/36*** | (2006.01) |
| ***F42B 33/00*** | (2006.01) |

(52) U.S. Cl.
CPC . *F41B 5/148* (2013.01); *F42B 6/06* (2013.01); *F42B 12/42* (2013.01); *F42B 12/362* (2013.01); *F42B 33/00* (2013.01); *Y10T 29/49902* (2015.01); *Y10T 29/53913* (2015.01)

(58) Field of Classification Search
CPC ..... F42B 6/06
See application file for complete search history.

(56) References Cited

U.S. PATENT DOCUMENTS

| | | | | |
|---|---|---|---|---|
| 4,544,163 | A | 10/1985 | Scanlon | |
| 5,154,432 | A | 10/1992 | Saunders | |
| 5,186,470 | A | 2/1993 | Easton et al. | |
| 5,987,724 | A * | 11/1999 | Kleman | 29/401.1 |
| 6,203,457 | B1 | 3/2001 | Snook | |
| 8,622,855 | B2 | 1/2014 | Bednar et al. | |

* cited by examiner

*Primary Examiner* — John Ricci
(74) *Attorney, Agent, or Firm* — Emerson Thomson Bennett

(57) ABSTRACT

An alignment tool may be used to align a nock with respect to an arrow having vanes. The alignment tool may include a body, a connection member extending from the body, and indicating surfaces that are spaced around the outer surface of the alignment tool body at a relative angular orientation that matches the angular orientation of the arrow vanes. The connection member may be attached to the nock and then both the tool and the nock may be rotated with respect to the arrow to align the nock with respect to the arrow by aligning the indicating surfaces with respect to the vanes.

20 Claims, 16 Drawing Sheets

METHOD AND APPARATUS FOR ALIGNING ARROW NOCKS

This patent application claims priority from U.S. provisional patent application Ser. No. 61/846,141 titled METHOD AND APPARATUS FOR ALIGNING ARROW NOCKS filed on Jul. 15, 2013, which is incorporated herein by reference.

I. BACKGROUND

A. Field of the Invention

This invention relates generally to arrows that are shot or fired by bows, crossbows and the like. More particularly, this invention relates to methods and apparatuses used to align arrow nocks to arrows.

B. Description of Related Art

FIG. 1 shows a known arrow 10 that may be shot or fired by a bow, a crossbow or other such device (hereinafter any and all devices that can propel or fire an arrow will be referred to as a "bow"). The arrow 10 may include a body 12 with an arrow head 14 positioned at the front end of the body 12 and three fletchings or vanes 16 positioned near the back end of the body 12. The arrow head 14 is the portion that strikes a target when the arrow 10 is shot. The vanes 16 act as airfoils and stabilize the arrow 10 when it is in flight. A nock 18 may be positioned at the back end of the arrow 10. The nock 18 has one end with an extension that is received in an opening in the arrow body 12. At the opposite end, the nock 18 has a head with a bowstring reception surface, typically in the form of a groove, which receives the bowstring on the bow that propels the arrow 10. More recently, it is known to provide arrows with lighted nocks. By "lighted" it is meant that a light source illuminates the nock so that the user can see the nock, and thus the arrow, after the arrow has been shot.

A known problem is properly aligning the nock, lighted or otherwise, with respect to the arrow. If the nock is not properly aligned, one or more of the vanes may contact the bow as the arrow is shot, decreasing the force and accuracy of the shot arrow. To assist with nock alignment, it is known to provide nocks with a tab or ridge on the head and to provide the arrow with an index or cock vane. Typically the index vane is provided with a unique color and thus is easily identified. To align the nock, the user inserts the extension of the nock into the arrow opening and then rotates the nock with his/her fingers with respect to the arrow until the tab is aligned with respect to the index vane. While the use of such nock tabs assist with alignment, they do not provide the precise alignment desired unless the user spends considerable time carefully rotating the nock while "eyeing" the relative position of the tab with the index vane.

What is needed is a tool and method to improve both the speed and accuracy of nock alignment with respect to an arrow.

II. SUMMARY

According to one embodiment of this invention, a method of aligning with respect to an arrow may comprises the steps of: (A) providing an arrow comprising: (1) a body having an opening; and, (2) first, second and third vanes extending outwardly from the body at an angular orientation; (B) providing one of: (1) a nock comprising: (a) a first end with an extension; (b) a second end with a bowstring reception surface that extends inwardly a maximum distance; and, (c) an opening formed on the second end that extends inwardly a distance that is greater than the bowstring reception surface maximum distance; and, (2) a nock assembly comprising a nock and an insert, wherein the nock comprises a bowstring reception surface and wherein the insert comprises: (a) a first end with an extension; and, (b) a second end with an opening; (C) providing an alignment tool comprising: (1) a body having an outer surface; (2) a connection member extending from the body; and, (3) a first indicating surface on the outer surface of the body; (D) one of: (1) if (B)(1): attaching the nock to the arrow by inserting the nock extension into the arrow opening; and, (2) if (B)(2): attaching the insert to the arrow by inserting the insert extension into the arrow opening; (E) one of: (1) if (B)(1): attaching the alignment tool to the nock by inserting the connection member into the nock opening; and, (2) if (B)(2): attaching the alignment tool to the insert by inserting the connection member into the insert opening; (F) one of: (1) if (B)(1): rotating the alignment tool and thus the nock with respect to the arrow until the first indicating surface is aligned with respect to one of the vanes; and, (2) if (B)(2): rotating the alignment tool and thus the insert with respect to the arrow until the first indicating surface is aligned with respect to one of the vanes; and, (G) removing the alignment tool from the arrow.

According to another embodiment of this invention, an alignment tool may be used with an associated arrow and an associated nock. The associated arrow may comprise (1) a body; and, (2) first, second and third vanes extending outwardly from the body at an angular orientation. The associated nock may comprise: (a) a connection surface that is connectable to the arrow body; (b) a bowstring reception surface that is designed to receive an associated bowstring to fire the associated arrow; and, (c) an opening. The alignment tool may comprise: a body having an outer surface; a connection member extending from the body; and, first and second indicating surfaces that are spaced around the outer surface of the alignment tool body at a relative angular orientation that matches the angular orientation of the first and second vanes on the arrow body. The alignment tool and associated nock may be rotatable with respect to the associated arrow when the associated nock is connected to the arrow body and the connection member is inserted into the opening in the nock to align the nock with respect to the arrow by aligning the first and second indicating surfaces with respect to the first and second vanes.

According to still another embodiment of this invention, an alignment tool and nock assembly may be used with an associated arrow. The associated arrow may comprise: (1) a body; and, (2) first, second and third vanes extending outwardly from the body at an angular orientation. The alignment tool may comprise: a body having an outer surface; a connection member extending from the body; and, first and second indicating surfaces that are spaced around the outer surface of the alignment tool body at a relative angular orientation that matches the angular orientation of the first and second vanes on the arrow body. The nock assembly may comprise: a nock comprising: (1) a bowstring reception surface that is designed to receive an associated bowstring to fire the associated arrow; and, (2) an extension having a shape; an insert comprising: (1) a connection surface that is connectable to the arrow body; and, (b) an opening having a shape. The alignment tool and insert may be rotatable with respect to the associated arrow when the insert is connected to the arrow body and the connection member is inserted into the opening in the insert to align the insert with respect to the arrow by aligning the first and second indicating surfaces with respect to the first and second vanes. The nock extension may be insertable into the opening of the aligned insert in a fixed number of relative positions based on the shape of the nock extension and the shape of the insert opening to align the nock with respect to the arrow.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
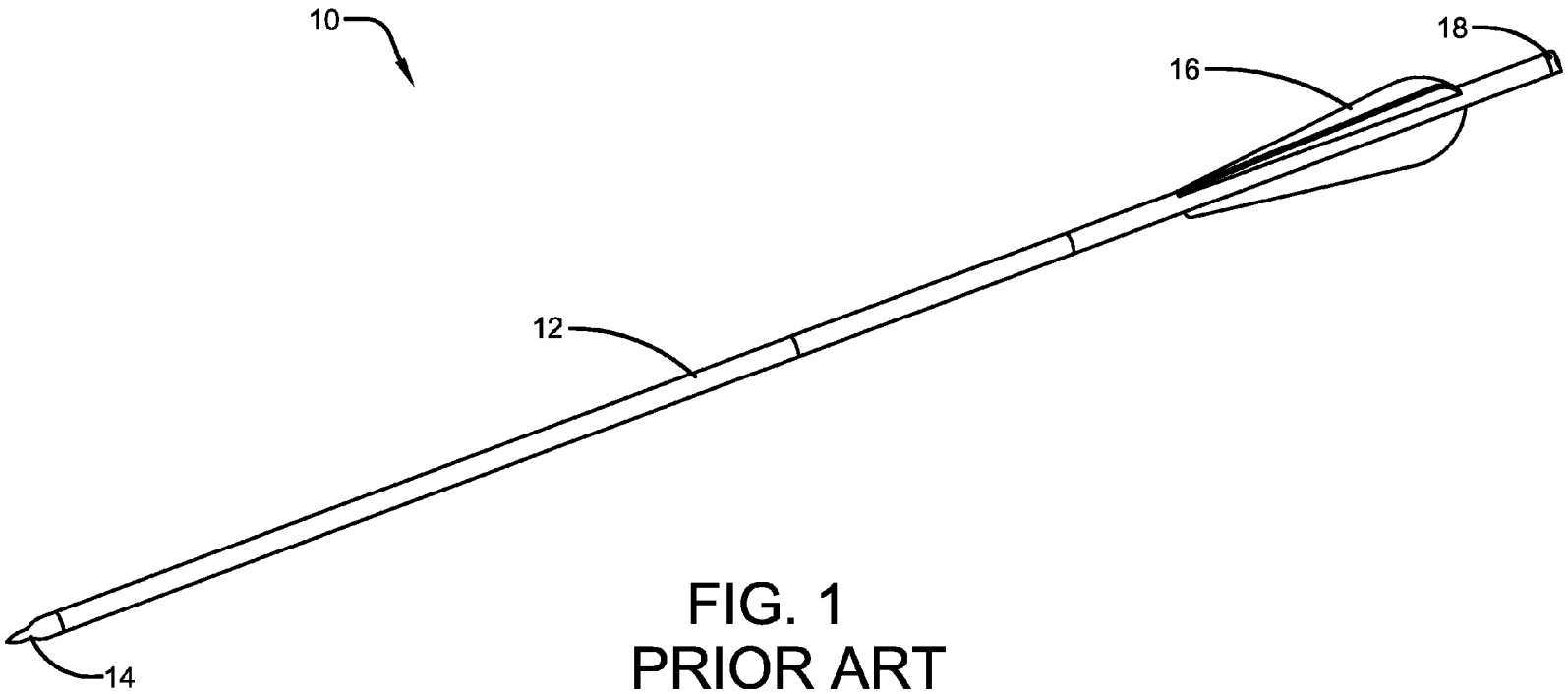
FIG. 1 PRIOR ART
FIG. 1 is a perspective view of a typical known arrow.
Figure 2:
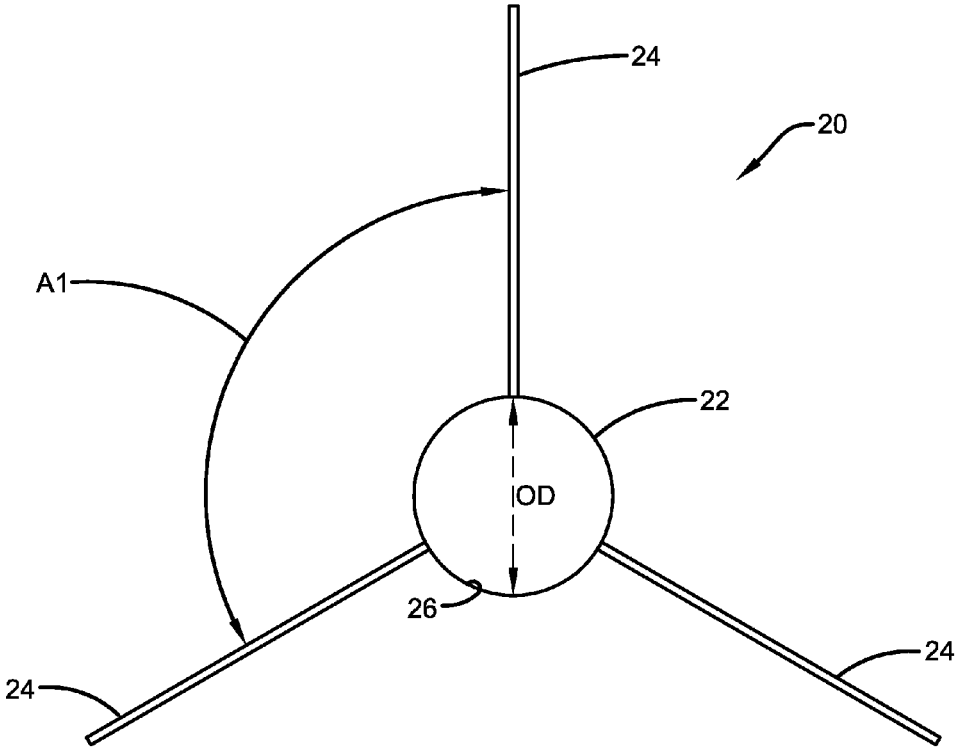
FIG. 2 is a back view of an arrow.

Referring now to the drawings wherein the showings are for purposes of illustrating embodiments of the invention only and not for purposes of limiting the same, and wherein like reference numerals are understood to refer to like components, FIG. 2 shows the back end of an arrow 20 which may be a typical known arrow. The arrow 20 may have a body 22, an arrow head (not shown but which may be similar to arrow head 14 shown in FIG. 1) and vanes 24. The back end of the body 22 may have an outside diameter OD. This back end is the location on the arrow 20 where a nock may be attached to the body 22. The body 22 may have a cylindrical opening 26 which extends along the length of the arrow 20 as is typical in arrows. The vanes 24 may extend outwardly from the body 22, as shown, and may have an angular orientation. For the embodiment shown, the angular orientation is an angle A1 between neighboring vanes 24 of 120 degrees. This is typical for arrows as it provides desirable stabilization for the arrow 20 when it is in flight. It should be noted, however, that this invention will work with any arrow chosen with the sound judgment of a person with skill in the art, including vanes having a different number of vanes and/or having a different angular orientation.

Figure 3:
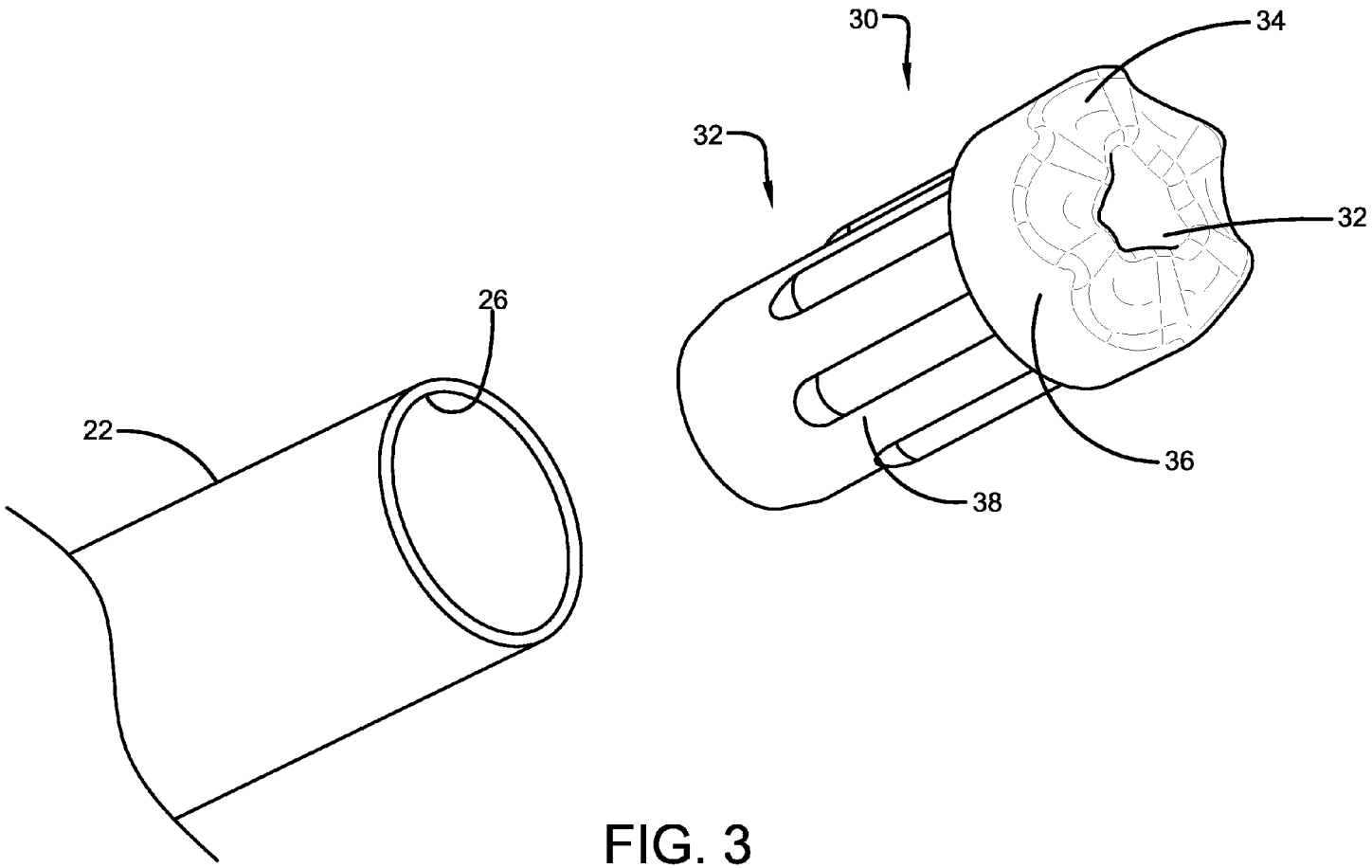
FIG. 3 is a side view of the back end of the arrow shown in FIG. 2 showing a nock according to some embodiments of this invention.

With reference now to FIGS. 2-3, a nock 30 may be attached to the arrow 20. The nock 30 may have a connection surface 32 that is connectable to the arrow body 22 and a bowstring reception surface 34 that is designed to receive the bowstring of a bow in order to propel or fire the arrow 20. The nock 30 may have a first end with an extension 38 that defines the connection surface 32 but it should be understood that this invention will work with nocks that connect to arrow bodies in other ways. The extension 38 may have a generally cylindrical shape, as shown. The outer surface of the extension 38 may be smooth, in one embodiment, or may have a textured surface as in the embodiment shown. To attach the nock 30 to the arrow 20, the extension 38 may be inserted into the opening 26 until a portion of a head 36 opposite the bowstring reception surface 34 contacts the back end of the arrow body 22. The nock 30 may be held in place by a friction fit or press fit between the extension 38 and the surface of the arrow 20 that defines the opening 26 although other methods of holding the nock 30 to the arrow 20 may also work with this invention, such as using an adhesive.

Figure 5:
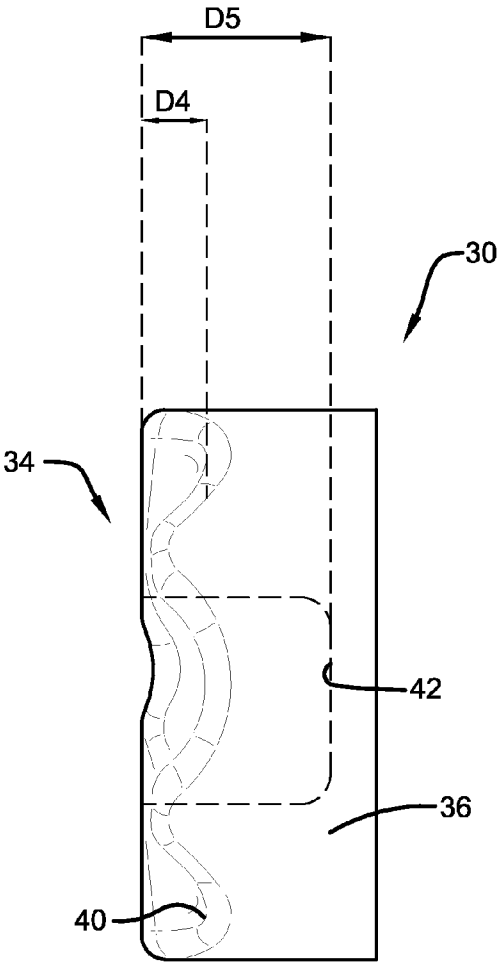
FIG. 5 is a side view of the nock head shown in FIGS. 2 and 3.
Figure 4:
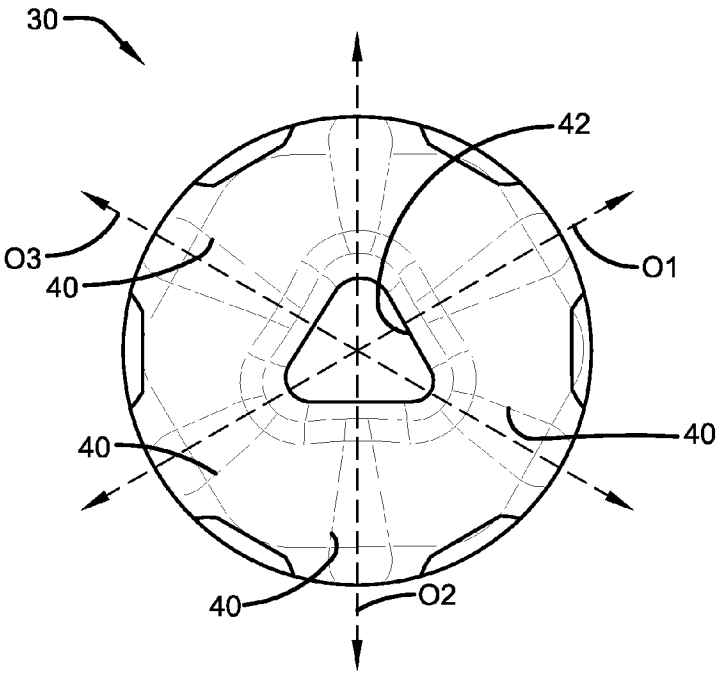
FIG. 4 is a front end view of the nock shown in FIG. 3.

With reference now to FIGS. 3-5, the nock 30 may have a second end with the head 36 upon which the bowstring reception surface 34 is formed. The bowstring reception surface 34 shown is designed to receive a bowstring in any one of three relative orientations, indicated with dashed lines O1, O2 and O3. It should be noted, however, that this invention will work with nocks having other bowstring reception surface designs. The bowstring reception surface 34 may comprise pairs of grooves 40 on opposite sides of an opening 42 to form the three bowstring reception orientation options. The grooves 40, and thus the bowstring reception surface 34, extend inwardly a maximum distance D4. The opening 42 extends inwardly a distance D5. Note that distance D5 is greater than distance D4. In one embodiment, the opening 42 extends all the way through the length of the nock 30.

With reference now to FIGS. 2-3 and 6-8, to properly align the nock 30 with respect to the vanes 16 on the arrow 20, an alignment tool 50 may be used. The alignment tool 50 may have a body 52 and a connection member 54. The connection member 54 may extend outwardly from the body 52, as shown. The connection member 54 may be shaped to be received within the opening 42 in the nock 30 so that once received within the opening 42, rotation of the alignment tool 50 will cause rotation of the nock 30 with respect to the arrow 20. In one embodiment, as seen best in FIG. 8, the outer surface of the connection member 54 is generally triangular in shape having three planar portions 56. Between the planar portions 56, the outer surface may have curved portions 58. The opening 42 in the nock 30, as seen best in FIG. 7 may have a matching shape with planar portions 60 and curved portions 62. While a triangular shape has advantages that will be described below, it should be understood that the connection member 54 and opening 42 can have any design chosen with the sound judgment of a person of skill in the art that permits rotation of the alignment tool 50 to cause rotation of the nock 30.

Figure 6:
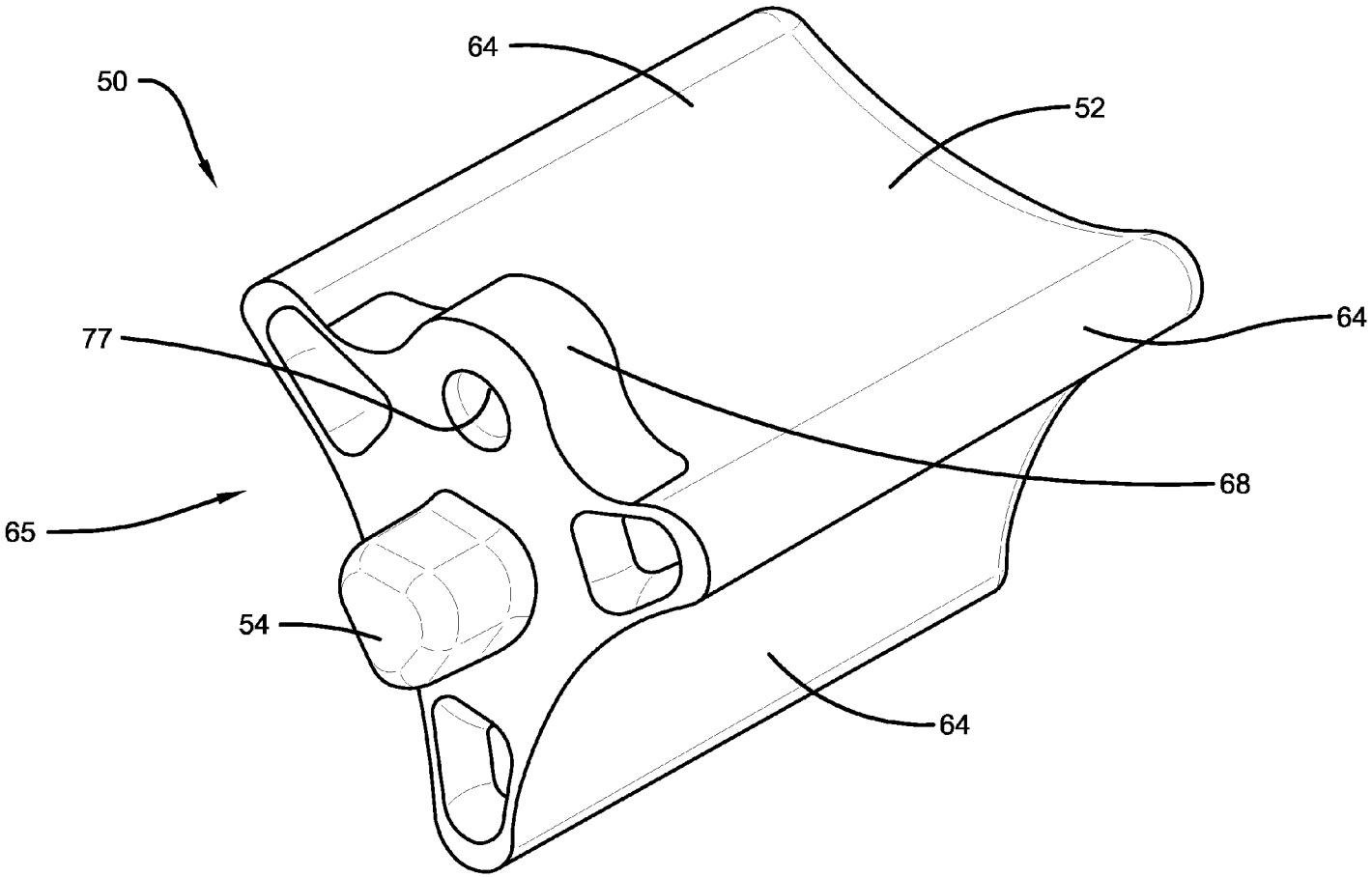
FIG. 6 is a perspective end view of an alignment tool according so some embodiments of this invention.

With reference now to FIG. 6, the attachment of the connection member 54 to the body 52 can be in any manner chosen with the sound judgment of a person of skill in the art. In one embodiment, the connection member 54 is made integrally, as one piece, with the body 52. In another embodiment, the connection member 54 can be selectively attached and detached from the body 52. In this case, a worn connection member 54 could be removed from the body 52 and a new connection member 54 could be added in its place. It is also contemplated to provide different connection members 54 having different sizes and/or shapes to correspond with different nocks. In this case, a connection member of one size and/or shape could be removed from the body 52 and replaced with a connection member of another size and/or shape.

With reference now to FIGS. 6 and 9-12, the body 52 of the alignment tool 50 may have any shape and size chosen with the sound judgment of a person of skill in the art. The body 52 may have at least two indicating surfaces 64 that are spaced around the outer surface of the alignment tool body 52 at a relative angular orientation that matches the angular orientation of the vanes 24 on the arrow body 22. In one embodiment, shown, there are three indicating surfaces 64 to match the number of vanes 24 on the typical arrow. For the embodiment shown, there is an angular orientation of 120 degrees, see angle A2 in FIG. 10, between the indicating surfaces 64 to match the 120 degree angular orientation of the vanes 24 on the arrow 20, as shown in FIG. 2. It should be understood, however, that the alignment tool body 52 can be designed to have indicating surfaces at any angular orientation to match the angular orientation of the vanes on an arrow. The indicating surfaces 64 can take any form chosen with the sound judgment of a person of skill in the art. In one embodiment, the indicating surfaces 64 are markings or indicia applied to the outer surface of the alignment tool body 52. For the embodiment shown, the indicating surfaces 64 are surfaces that extend or project outwardly from the alignment tool body 52. In one embodiment, the indicating surfaces 64 have an angular orientation that matches the connection member 54. In one specific embodiment, as seen best in FIG. 10, the indicating surfaces 64 have an angular orientation that matches the curved portions 58 of the connection member 54. In an alternate embodiment, the indicating surfaces 64 could be positioned to have an angular orientation that matches the planar portions 56 of the connection member 54.

Figure 10:
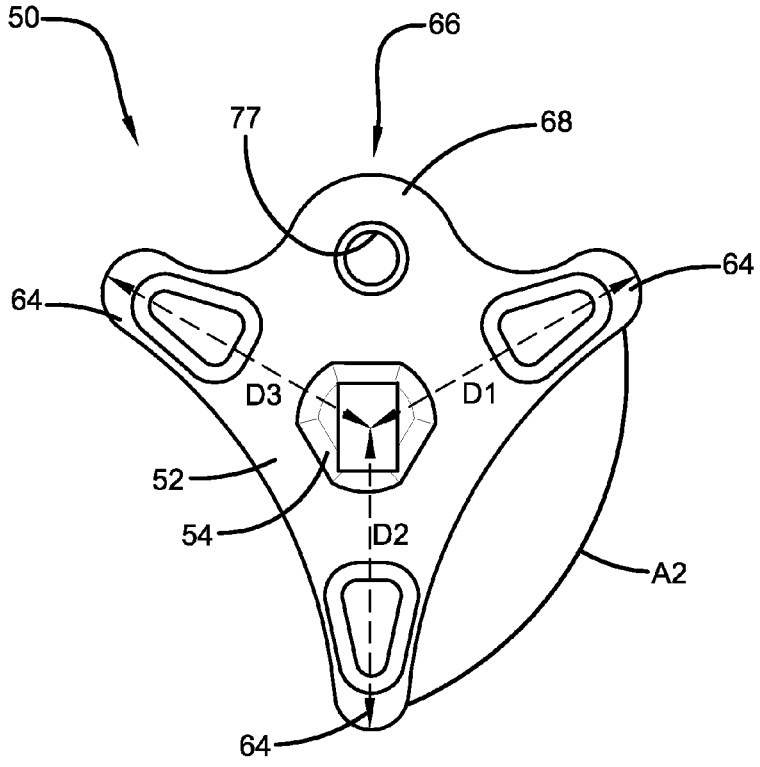
FIG. 10 is an end view of the alignment tool taken along line 10-10 in FIG. 9.
Figure 11:
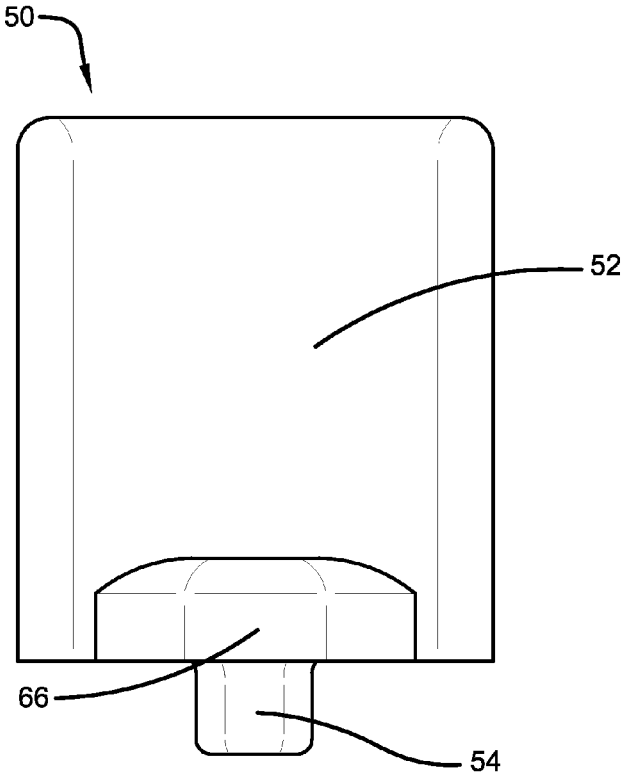
FIG. 11 is a top view of the alignment tool shown in FIG. 6.
Figure 12:
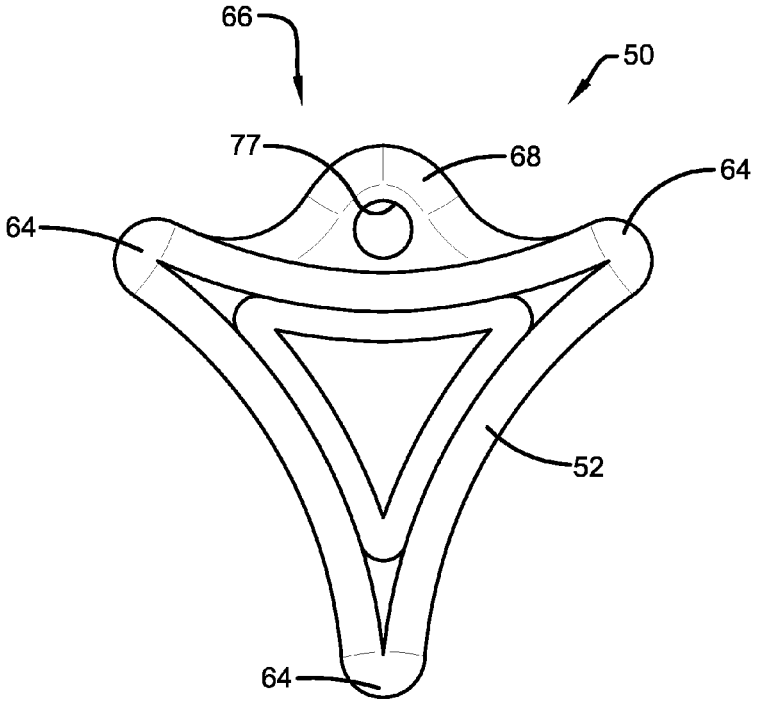
FIG. 12 is an end view of the alignment tool taken along line 12-12 in FIG. 9.

With continuing reference to FIGS. 6 and 9-12, the indicating surfaces 64 may be spaced from a longitudinal axis LA of the connection member 54. FIG. 10 shows three indicating surfaces 64 spaced distances D1, D2 and D3 from the longitudinal axis LA. It should be noted that for the embodiment shown, distances D1, D2 and D3 are greater than the outside diameter OD, shown in FIG. 2, of the back end of the arrow body 22. The embodiment shown also provides that distances D1, D2 and D3 are equal to each other but in another embodiment they are not equal. The outer surface of the alignment tool body 54 may extend inwardly between the indicating surfaces 64. For the embodiment shown, the outer surface of the alignment tool body 54 extends inwardly along a curved surface between the indicating surfaces 64.

Still referring to FIGS. 6 and 9-12, the alignment tool 50 may also have an attachment surface 66. The attachment surface 66 may be used to attach the alignment tool 50 to another object for safe keeping. The alignment tool 50 may, for example, be attached to a bow. For another example, the alignment tool 50 may be attached to a user's key chain or the like. While the attachment surface 66 may have any shape and size chosen with the sound judgment of a person of skill in the art, for the embodiment shown the attachment surface 66 includes an extension surface 68 that extends from the body 52 and an opening 77.

Figure 27:
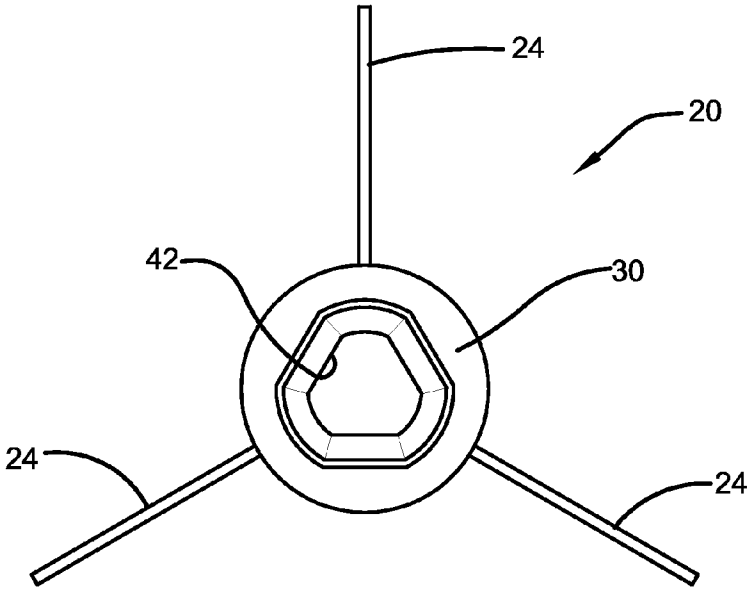
FIG. 27 is a back end view of an arrow with a nock attached to the arrow.

To use the alignment tool 50, shown in FIG. 6, with the nock 30, shown in FIGS. 3-5, the user may begin with the arrow 20 as shown in FIG. 2. The user may then attach the nock 30 to the arrow 20. In one embodiment, this is done by inserting the nock extension 38 into the arrow opening 26, as described above and shown in FIG. 27. The alignment tool 50 may then be attached to the nock 30. Alternatively, the user may attach the alignment tool 50 to the nock 30 and then attach the nock 30 to the arrow 20. To attach the alignment tool 50 to the nock 30, the user simply inserts the connection member 54 into the opening 42. To make this insertion, with reference to FIGS. 7-8, the planar portions 56 of the connection member 54 are juxtaposed to the planar portions 60 in the nock opening 42 and the curved portions 58 of the connection member 54 are juxtaposed to the curved portions 62 in the nock opening 42. Because, in the embodiment shown, there are three juxtaposed planar portions and three juxtaposed curved portions, there are three relative orientations where the alignment tool 50 can be received in the opening 42. All three work equally well, provided that the bowstring reception surface 34 is designed to receive a bowstring in any one of three relative orientations, as discussed above.

Figure 28:
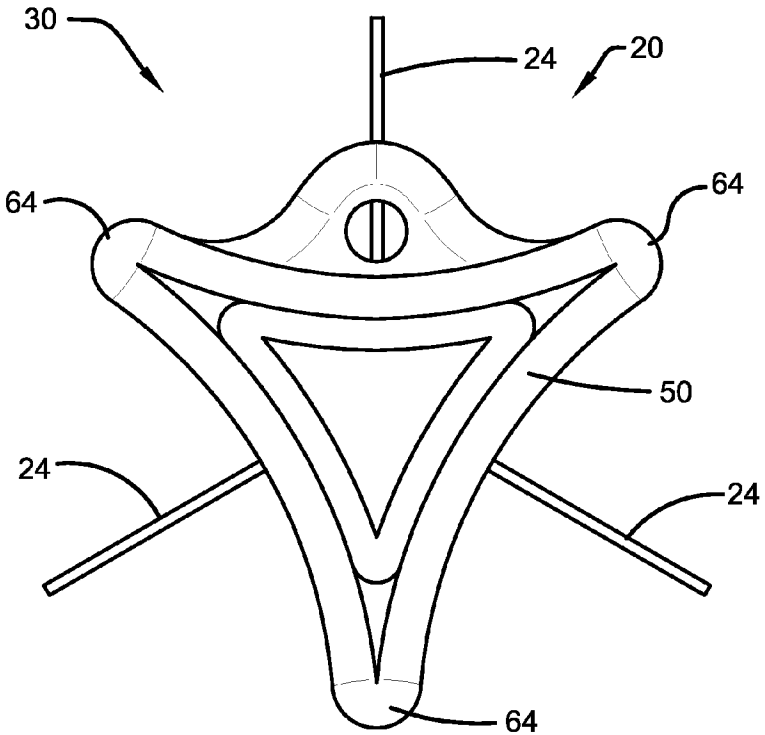
FIG. 28 is a back end view of the arrow shown in FIG. 27 but with the alignment tool attached to the nock.
Figure 29:
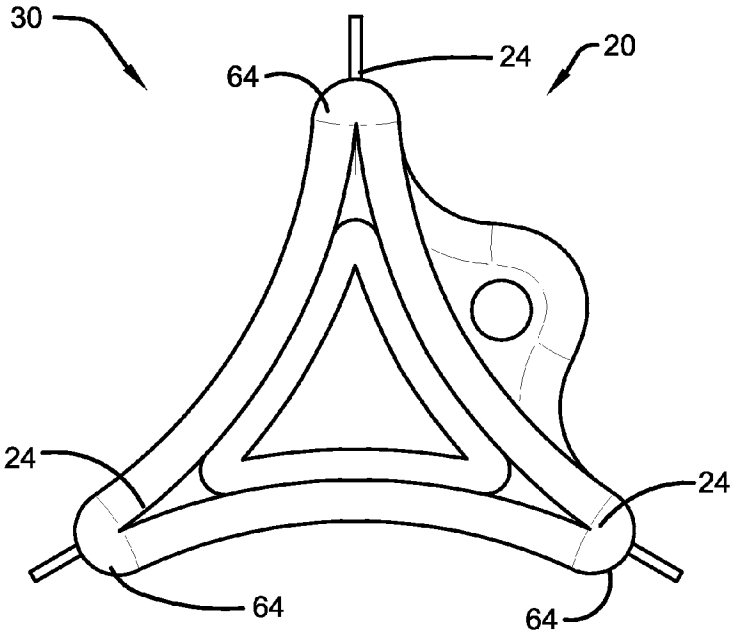
FIG. 29 is a back end view similar to that shown in FIG. 28 but with the alignment tool and nock rotated to align the nock with respect to the arrow's vanes.

With reference now to FIGS. 3-6, once the alignment tool 50 has been attached to the nock 30, the nock 30 may be inserted into the opening 26 in the arrow 20 as described above (unless the nock 30 has already been inserted). FIG. 28 shows the alignment tool 50 attached to the nock 30 and the nock 30 attached to the arrow 20. To then align the nock 30 with respect to the vanes 24 on the arrow 20, it is only necessary to rotate the alignment tool 50, and thus the nock 30, with respect to the arrow 20 until the indicating surfaces 64 are aligned with respect to the vanes 24. With this invention, alignment can be quickly and easily seen by the user. This is shown, for example, in FIG. 29. It should be noted, however, that while proper alignment for the embodiment shown occurs when the indicating surfaces 64 and vanes 24 have the same angular orientation, in other embodiments proper alignment may occur when the indicating surfaces 64 and vanes 24 have different angular orientations (though they may maintain the same relative angular orientation, such as 120 degrees, for example). As an example of this embodiment, FIG. 28 might show proper alignment. All that is necessary is that the indicating surfaces 64 be properly aligned with respect to the vanes 24 for any particular application. Once proper alignment has been achieved, the user can easily remove the alignment tool 50 from the arrow 20 by removing the connection member 54 from the nock opening 42.

Figure 13:
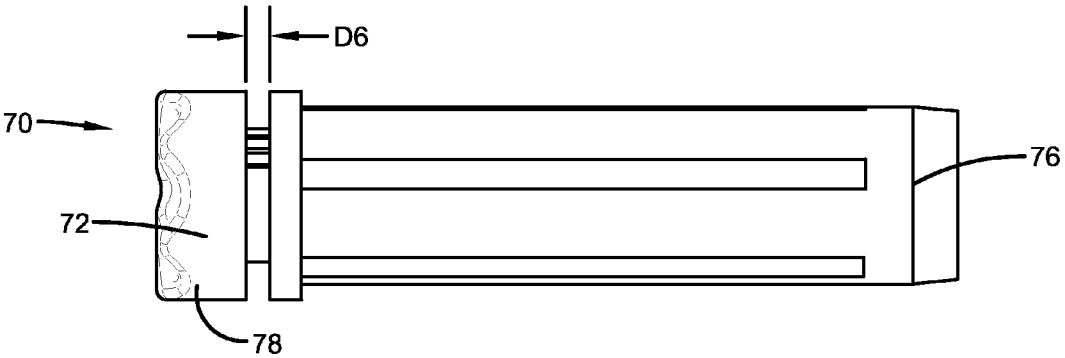
FIG. 13 is a side view of a lighted nock assembly according to some embodiments of this invention.
Figure 14:
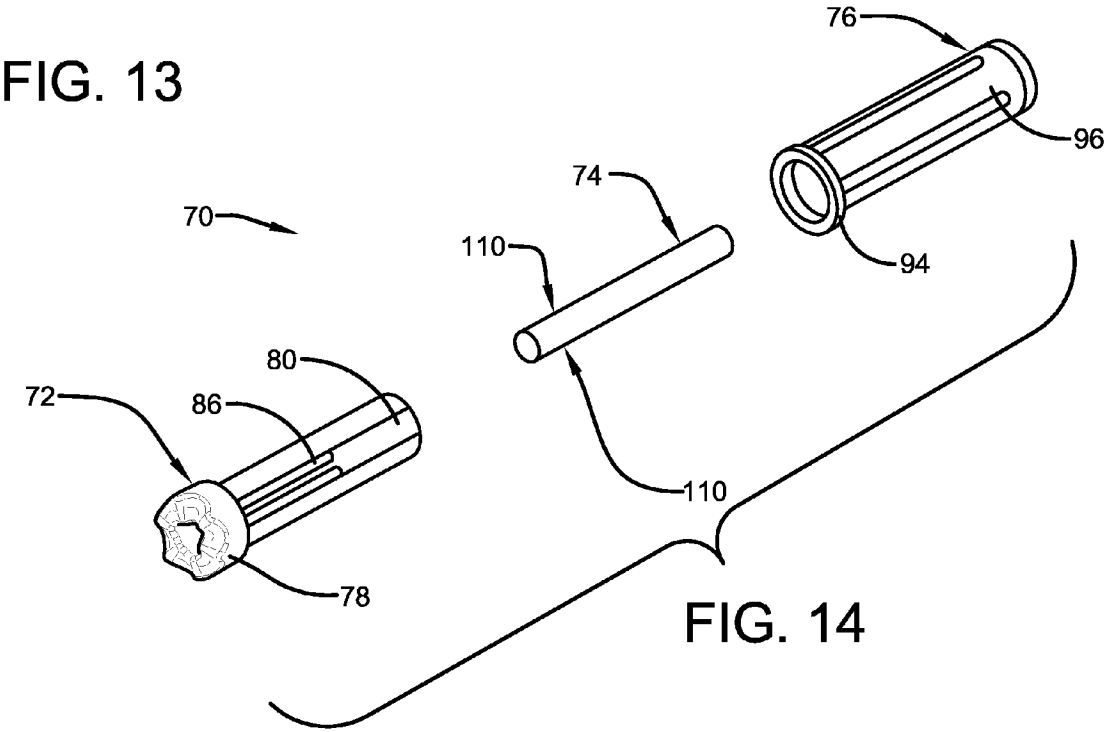
FIG. 14 is an exploded view of the lighted nock assembly shown in FIG. 13.
Figure 16:
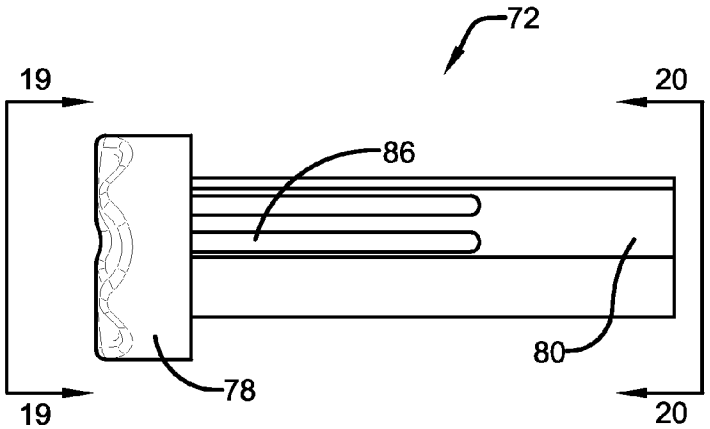
FIG. 16 is a side view of the nock shown in FIG. 14.
Figure 15:
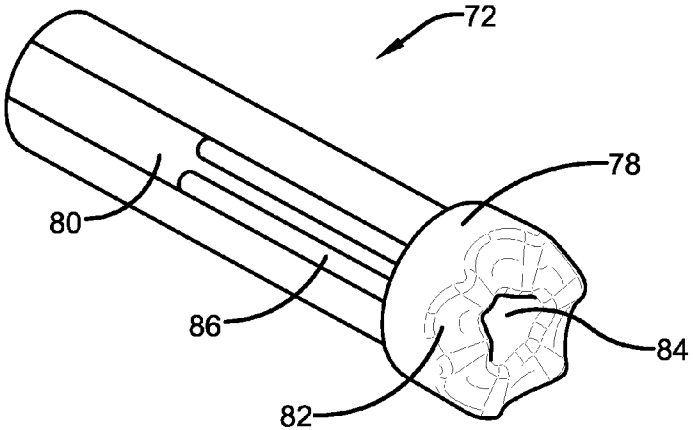
FIG. 15 is a perspective view of the nock shown in FIG. 14.

In another embodiment, a nock may be lighted. By "lighted" it is meant that a light source may illuminate the nock when activated so that the user can see the arrow after it has been shot. FIGS. 13-14, show the components of a lighted nock assembly 70 according to some embodiments of this invention. The lighted nock assembly 70 may include a nock 72, an LED-battery combination component 74, and an insert 76. The LED-battery combination component 74 may, in one embodiment, be activated by applying a compression force to the LED-battery combination component 74.

With reference now to FIGS. 13-20, the nock 72 may have a connection surface 80 that is connectable to the insert 76 and a bowstring reception surface 82 that is designed to receive a bowstring. For the embodiment shown, the nock 72 may have a first end with an extension that defines the connection surface 80 but it should be understood that this invention will work with nocks that connect to inserts in other ways. The extension may have a generally cylindrical shape, as shown. The outer surface of the extension may be smooth, in one embodiment, or may have a textured surface in another embodiment. For the embodiment shown, the outer surface of the extension may have slots 86, as shown. The extension may have an opening 88. The opening 88 may communicate with an opening 84, as shown. In one embodiment, the outer surface of the extension is generally triangular in shape having three planar portions 90 connected by three curved portions 92. The purpose for this shape will be discussed further below. The nock 72 may have a second end with a head 78 upon which a bowstring reception surface 82 is formed. The bowstring reception surface 82 may be designed to receive a bowstring in any one of three relative orientations, as described above, but this invention will work with nocks having other bowstring reception surface designs. The opening 84 may be formed in the head 78, as shown.

With reference now to FIGS. 2-3, 13-14 and 21-26, the insert 76 may have a connection surface 96 that is connectable to the arrow body 22 and an opening 98. The insert 76 may have a first end with an extension that defines the connection surface 96 but it should be understood that this invention will work with inserts that connect to arrow bodies in other ways. The extension may have a generally cylindrical shape, as shown. The outer surface of the extension may be smooth, in one embodiment, or may have a textured surface in another embodiment. For the embodiment shown, the outer surface of the extension may have ribs 104 that extend longitudinally, as shown. While five ribs 104 are shown, any proper number of ribs could be used. The extension may have an opening 106 that communicates with the opening 98 which may be formed in a head 94, as shown. The end of the extension opposite the head 94 may have a wall 108 that encloses the extension. To attach the insert 76 to the arrow 20, the extension may be inserted into the opening 26 until an edge of the head 94 closest to the extension contacts the back end of the arrow body 22. The insert 76 may be held in place by a friction fit between the extension and the surface of the arrow 20 that defines the opening 26 although other methods of holding the insert 76 to the arrow 20 may also work with this invention.

With reference now to FIGS. 21-26, the opening 98 in the head 94 of the insert 76 may match the connection member 54 of the alignment tool 50 (shown in FIG. 6). In another embodiment, shown, the opening 98 also matches the outer surface of the extension of the nock 72 (shown in FIG. 15). In one specific embodiment, as seen best in FIG. 20, the opening 98 may have a matching triangular shape. Specifically, the opening 98 may have three planar portions 100 and three curved portions 102. This design permits the extension of the nock 72, and thus the nock 72, to be insertable into the insert 76 in at least one, three shown, specific relative positions.

Figure 8:
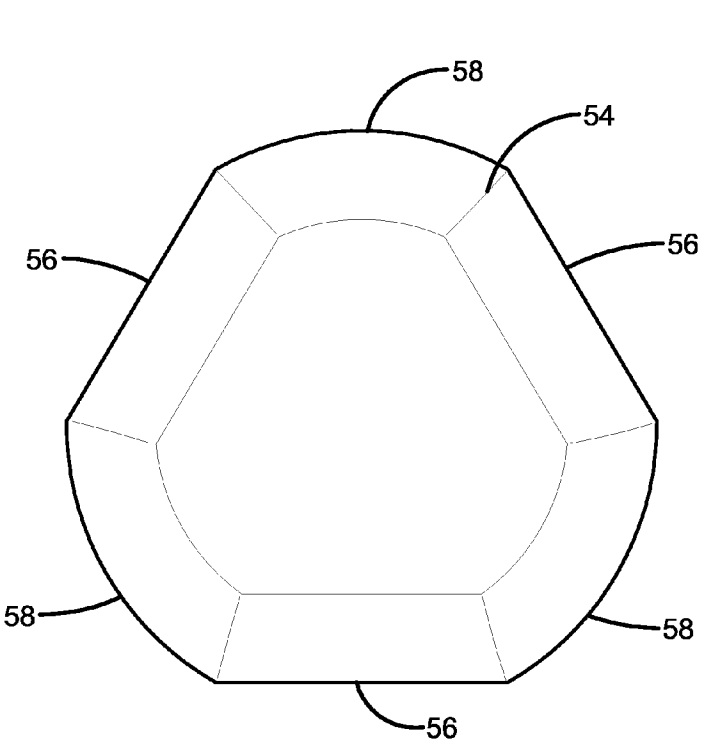
FIG. 8 shows the shape of the connection member shown in FIG. 6.
Figure 7:
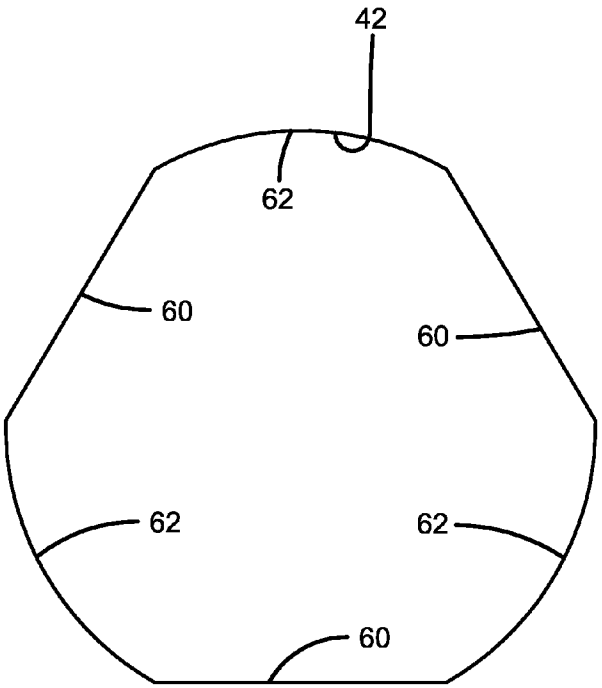
FIG. 7 shows the shape of the opening in the nock shown in FIGS. 3-5.
Figure 9:
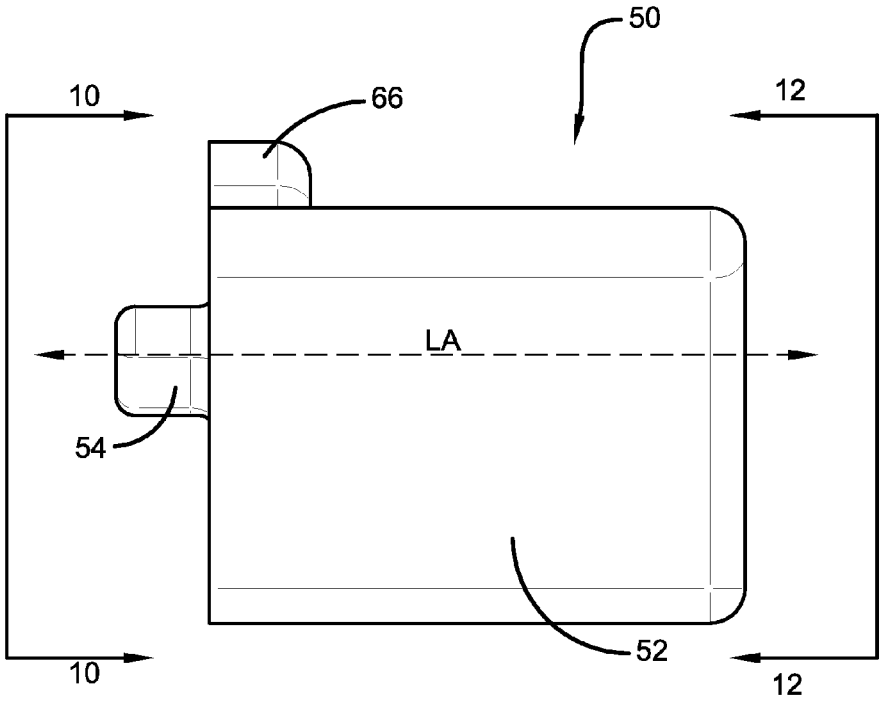
FIG. 9 is a side view of the alignment tool shown in FIG. 6.
Figure 30:
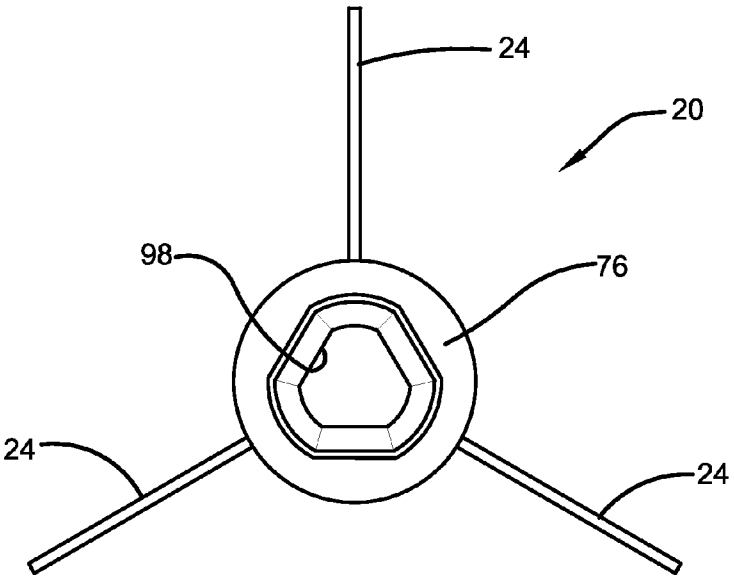
FIG. 30 is a back end view of an arrow with an insert attached to the arrow.
Figure 32:
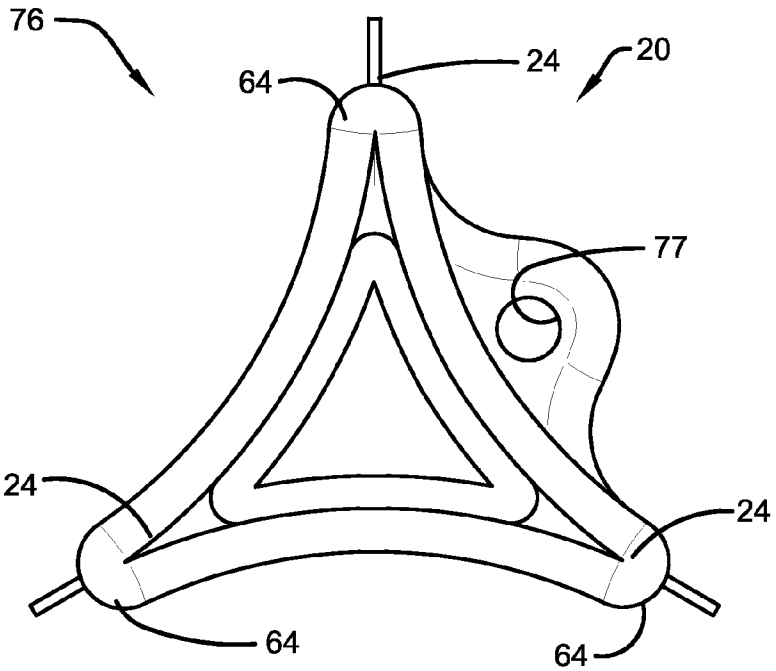
FIG. 32 is a back end view similar to that shown in FIG. 31 but with the alignment tool and insert rotated to align the insert with respect to the arrow's vanes.
Figure 31:
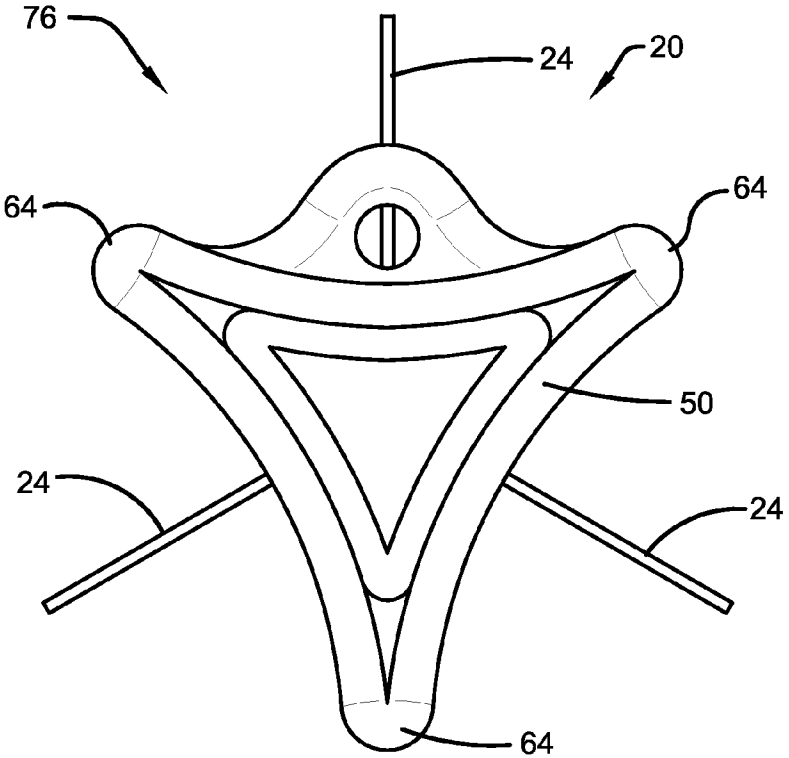
FIG. 31 is a back end view of the arrow shown in FIG. 30 but with the alignment tool attached to the insert.

To use the alignment tool 50, shown in FIG. 6, with the lighted nock assembly 70, shown in FIGS. 13-14, the user may begin with the arrow 20 as shown in FIG. 2. The user may first insert the insert 76 into the arrow opening 26. More specifically, the insert extension may be inserted into the opening 26 in the arrow 20 in the same manner as the nock extension 38, shown in FIG. 3, as described above and shown in FIG. 30. The alignment tool 50 may then be attached to the insert 76. Alternatively, the user may attach the alignment tool 50 to the insert 76 and then insert the insert 76 into the arrow 20. To attach the alignment tool 50 to the insert 76, the user simply inserts the connection member 54 into the opening 98 in the head 94, as seen best in FIGS. 21 and 25. To make this insertion the planar portions 56 of the connection member 54, shown in FIG. 8, are juxtaposed to the planar portions 100 in the insert opening 98, shown in FIG. 25, and the curved portions 58 of the connection member 54 are juxtaposed to the curved portions 102 in the insert opening 98. Because, in the embodiment shown, there are three juxtaposed planar portions and three juxtaposed curved portions, there are three relative orientations where the alignment tool 50 can be received in the opening 98. All three work equally well. FIG. 31 shows the alignment tool 50 attached to the insert 76 and the insert 76 attached to the arrow 20. Once the alignment tool 50 has been attached to the insert 76, the insert 76 may be inserted into the opening 26 in the arrow 20 as described above (unless the insert 76 has already been inserted). To then align the insert 76 with respect to the vanes 24 on the arrow 20, it is only necessary to rotate the alignment tool 50, and thus the insert 76, with respect to the arrow 20 until the indicating surfaces 64 are aligned with respect to the vanes 24. With this invention, alignment can be quickly and easily seen by the user. This is shown, for example, in FIG. 32. In some embodiments, the opening 77 may be used as a reference hole that is aligned with a cock vane (not shown). As with the nock noted above, alignment of the insert 76 with respect to the vanes 24 may vary depending on application. Once proper alignment has been achieved, the user can easily remove the alignment tool 50 from the arrow 20 by removing the connection member 54 from the insert opening 98.

Figure 17:
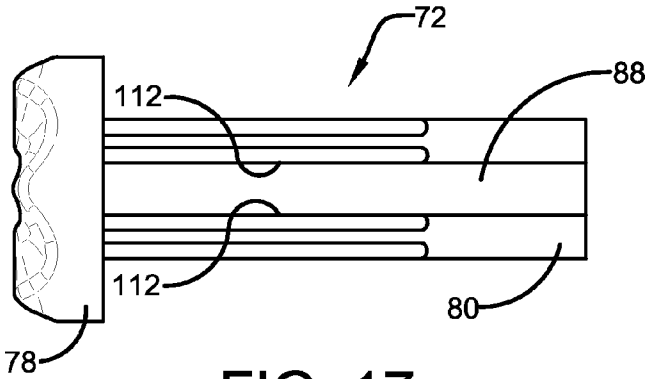
FIG. 17 is a top view of the nock shown in FIG. 14.
Figure 18:
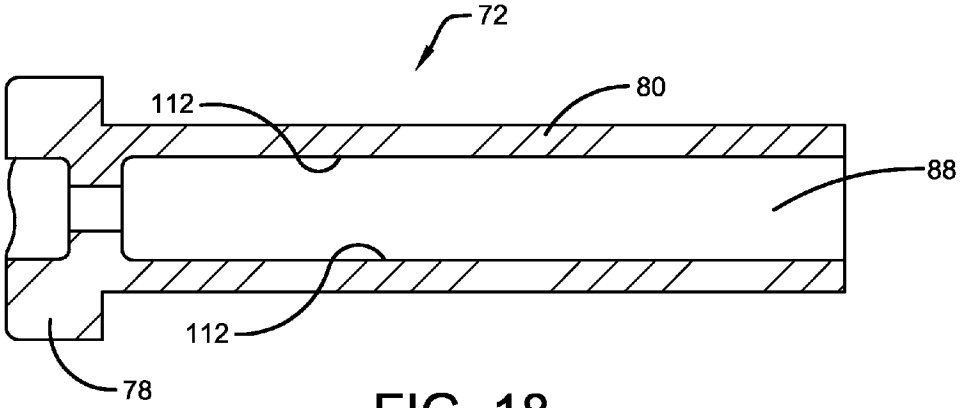
FIG. 18 is a sectional view of the nock taken along the line 18-18 in FIG. 19.
Figure 20:
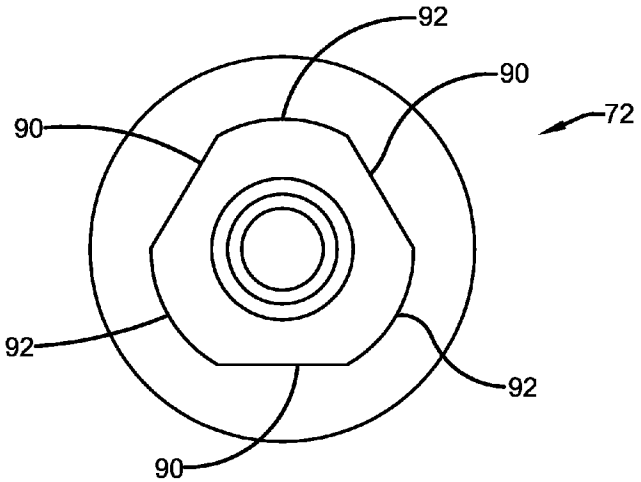
FIG. 20 is an end view of the nock taken along the line 20-20 in FIG. 16.
Figure 19:
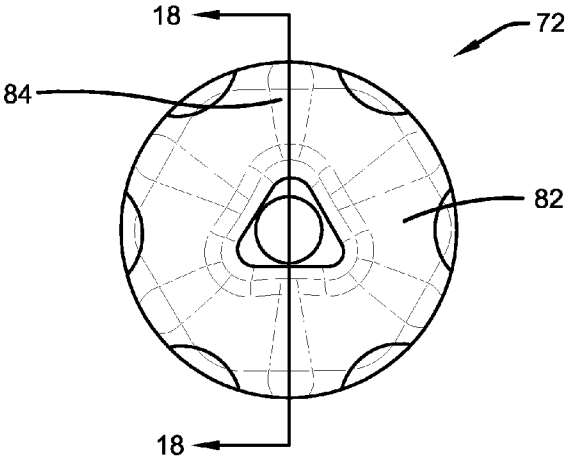
FIG. 19 is an end view of the nock taken along the line 19-19 in FIG. 16.
Figure 21:
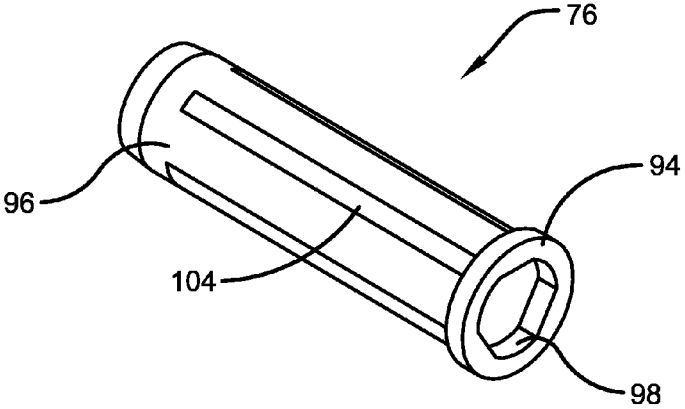
FIG. 21 is a perspective view of the insert shown in FIG. 14.
Figure 22:
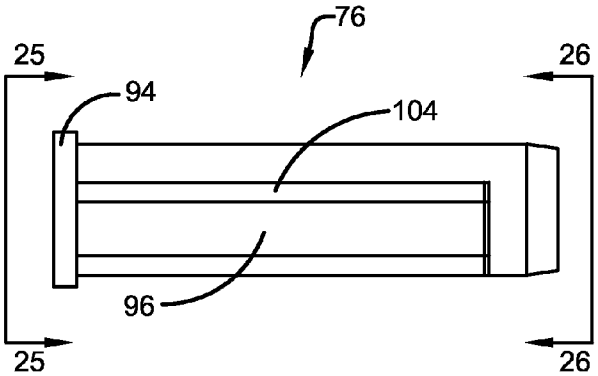
FIG. 22 is a side view of the insert shown in FIG. 14.
Figure 23:
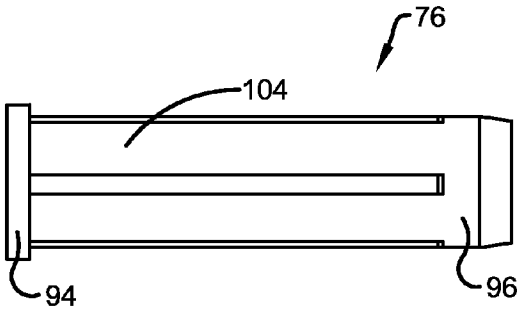
FIG. 23 is a top view of the insert shown in FIG. 14.
Figure 24:
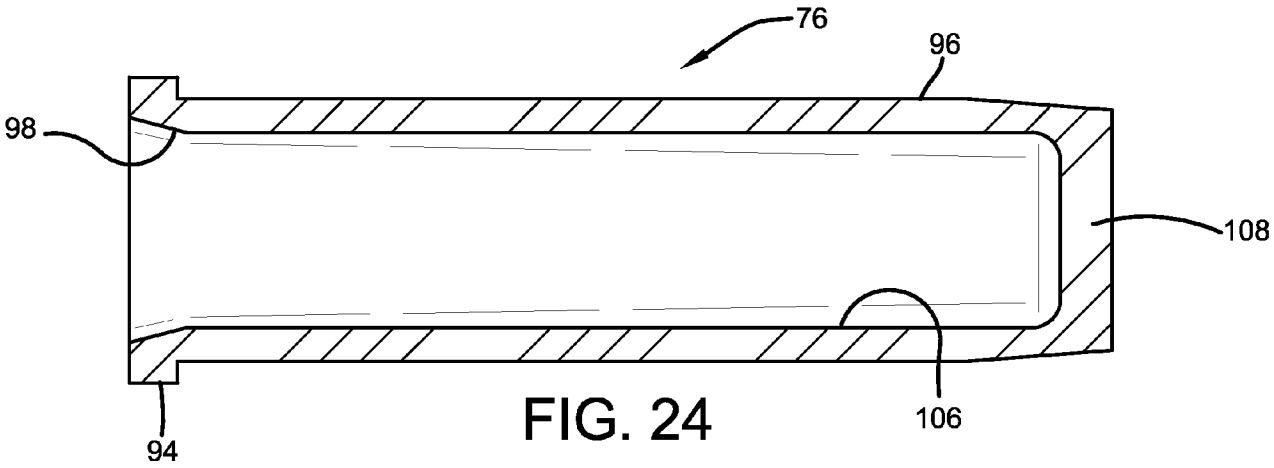
FIG. 24 is a sectional view of the insert taken along the line 24-24 in FIG. 25.
Figure 26:
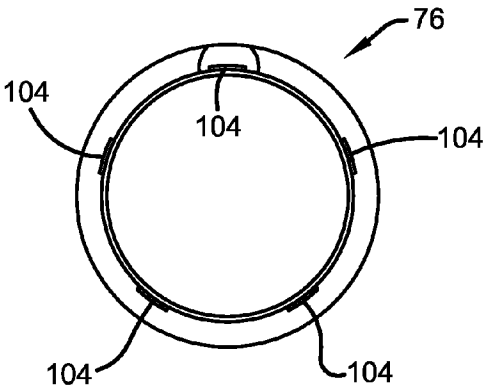
FIG. 26 is an end view of the insert taken along the line 26-26 of FIG. 22.
Figure 25:
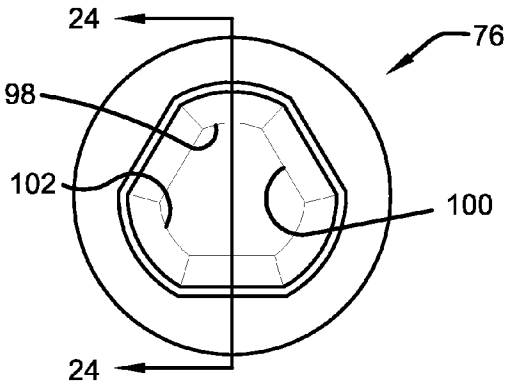
FIG. 25 is an end view of the insert taken along the line 25-25 of FIG. 22.

The LED-battery combination component 74, shown in FIG. 14, may then be inserted into the opening 88, shown in FIGS. 17-18, in the nock 72. In one embodiment, the LED-battery combination component 74 has an outer surface 110, at least part of which may be held in place by a friction fit or press fit with inner surface 112 of the nock opening 88. It should be noted, however, that other methods of holding the LED-battery combination component 74 to the nock 72 may also work with this invention. The nock 72 and LED-battery combination component 74 may then be simultaneously inserted into the openings 98 and 106 in the insert 76, shown in FIGS. 24-25, with the result shown in FIG. 13. Note that for the embodiment shown, the nock head 78 remains outside the insert 76 when the notch extension is inserted into the insert opening 98. Note also that for the embodiment shown in FIG. 13, a gap D6, which may be about the thickness of a dime, is maintained between the head 78 of the nock 72 and the end of the insert 76 to prevent the LED from illuminating before it is desired. To make this insertion the planar portions 90 of the nock 72, shown in FIG. 20, are juxtaposed to the planar portions 100 of the insert opening 98, shown in FIG. 25, and the curved portions 92 of the nock 72 are juxtaposed to the curved portions 102 in the insert opening 98. Because, in the embodiment shown, there are three juxtaposed planar portions and three juxtaposed curved portions, there are three relative orientations where the nock 72 can be received in the opening 98. All three work equally well for the nock 72 as its contact surface 82, as seen best in FIG. 19, provides three bowstring reception areas that can be used to receive and contact the bowstring, as shown. In this way, the nock 72 is aligned both with respect to the insert 76 and with respect to the vanes 24 on the arrow 20. When the lighted nock assembly 70 is attached to an arrow and the arrow is fired, the bowstring will contact the nock 72 closing the gap D6 and causing the LED to illuminate.

With reference now FIGS. 11-14 and 17-18, if it is desired to remove the nock 72 from the insert 74, the user can simply grip the head 78 of the nock 72 and pull it out of the insert openings 98, 106. If the LED-battery combination component 74 was press fit or otherwise attached to the nock 72, removing the nock 72 from the insert 74 will simultaneously remove the LED-battery combination component 74 from the insert 76. The LED-battery combination component 74 can then be easily removed from the nock 72 by pulling it out of the nock opening 88, if desired.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved

We claim:

1. A method of aligning with respect to an arrow comprising the steps of:

(A) providing an arrow comprising: (1) a body having an opening; and, (2) at least first, second and third vanes extending outwardly from the body at an angular orientation;

(B) providing one of:

(1) a nock comprising: (a) a first end with an extension; (b) a second end with a bowstring reception surface that extends inwardly a maximum distance; and, (c) an opening formed on the second end that extends inwardly a distance that is greater than the bowstring reception surface maximum distance; and, (2) a nock assembly comprising a nock and an insert, wherein the nock comprises a bowstring reception surface and wherein the insert comprises: (a) a first end with an extension; and, (b) a second end with an opening;

(C) providing an alignment tool comprising: (1) a body having an outer surface; (2) a connection member extending from the body; and, (3) a first indicating surface on the outer surface of the body;

(D) one of:

(1) if (B)(1): attaching the nock to the arrow by inserting the nock extension into the arrow opening; and, (2) if (B)(2): attaching the insert to the arrow by inserting the insert extension into the arrow opening;

(E) one of:

(1) if (B)(1): attaching the alignment tool to the nock by inserting the connection member into the nock opening; and, (2) if (B)(2): attaching the alignment tool to the insert by inserting the connection member into the insert opening;

(F) one of:

(1) if (B)(1): rotating the alignment tool and thus the nock with respect to the arrow until the first indicating surface is aligned with respect to one of the vanes; and, (2) if (B)(2): rotating the alignment tool and thus the insert with respect to the arrow until the first indicating surface is aligned with respect to one of the vanes; and, (G) removing the alignment tool from the arrow.

2. The method of claim 1 wherein step (D) occurs before step (E).

3. The method of claim 1 wherein step (E) occurs before step (D).

4. The method of claim 1 wherein:

step (C) comprises the step of further providing the alignment tool with second and third indicating surface on the outer surface of the body, wherein the first, second and third indicating surfaces are spaced around the outer surface of the alignment tool body at a relative angular orientation that matches the angular orientation of the first, second and third vanes on the arrow body; and, step (F) comprises one of:

(1) if (B)(1): rotating the alignment tool and thus the nock with respect to the arrow until the first, second and third indicating surfaces are aligned with respect to the first, second and third vanes; and, (2) if (B)(2): rotating the alignment tool and thus the insert with respect to the arrow until the first, second and third indicating surfaces are aligned with respect to the first, second and third vanes.

5. The method of claim 1 wherein:

step (B) comprises one of:

(1) if (B)(1): providing the nock opening with at least one planar portion and at least one curved portion;

(2) if (B)(2): providing the insert opening with at least one planar portion and at least one curved portion;

step (C) comprises the step of: providing the connection member with an outer surface having at least one planar portion and at least one curved portion; and, step (E) comprises one of:

(1) if (B)(1): attaching the alignment tool to the nock by juxtaposing the at least one planar portion of the connection member with the at least one planar portion of the nock opening and by juxtaposing the at least one curved portion of the connection member with the at least one curved portion of the nock opening; and, (2) if (B)(2): attaching the alignment tool to the insert by juxtaposing the at least one planar portion of the connection member with the at least one planar portion of the insert opening and by juxtaposing the at least one curved portion of the connection member with the at least one curved portion of the insert opening.

6. An alignment tool for use with an associated arrow and an associated nock, wherein:

the associated arrow comprises (1) a body; and, (2) first, second and third vanes extending outwardly from the body at an angular orientation;

the associated nock comprises: (a) a connection surface that is connectable to the arrow body; (b) a bowstring reception surface that is designed to receive an associated bowstring to fire the associated arrow; and, (c) an opening;

the alignment tool comprises:

a body having an outer surface;

a connection member extending from the body; and, first and second indicating surfaces that are spaced around the outer surface of the alignment tool body at a relative angular orientation that matches the angular orientation of the first and second vanes on the arrow body; and, the alignment tool and associated nock are rotatable with respect to the associated arrow when the associated nock is connected to the arrow body and the connection member is inserted into the opening in the nock to align the nock with respect to the arrow by aligning the first and second indicating surfaces with respect to the first and second vanes.

7. The alignment tool of claim 6 wherein:

the alignment tool comprises a third indicating surface that is spaced on the outer surface of the alignment tool body at a relative angular orientation that matches the angular orientation of the third vane on the arrow body; and, the alignment tool and associated nock are rotatable with respect to the associated arrow when the associated nock is connected to the arrow body and the connection member is inserted into the opening in the nock to align the nock with respect to the arrow by aligning the third indicating surface with respect to the third vane.

8. The alignment tool of claim 6 wherein:

the opening in the associated nock comprises at least one planar portion and at least one curved portion;

the connection member has an outer surface comprising at least one planar portion and at least one curved portion; and, when the connection member is inserted into the opening in the nock: the at least one planar portion of the connection member is juxtaposed to the at least one planar portion of the nock opening; and, the at least one curved portion of the connection member is juxtaposed to the at least one curved portion of the nock opening.

9. The alignment tool of claim 6 wherein the first and second indicating surfaces are spaced substantially an equal distance from a longitudinal axis of the connection member.

10. The alignment tool of claim 6 wherein:

the associated arrow body has an outside diameter OD at a location where the associated nock is connected to the arrow body;

the first indicating surface is spaced a distance D1 from a longitudinal axis of the connection member;

the second indicating surface is spaced a distance D2 from the longitudinal axis of the connection member;

D1 is greater than OD; and,

D2 is greater than OD.

11. The alignment tool of claim 6 wherein the outer surface of the alignment tool body extends inwardly between the first and second indicating surfaces.

12. The alignment tool of claim 6 wherein:

the opening in the associated nock comprises first and second planar portions and first and second curved portions;

the connection member has an outer surface comprising first and second planar portions and first and second curved portions that have the same angular orientation as the first and second indicating surfaces; and, when the connection member is inserted into the opening in the nock: the first and second planar portions of the connection member are juxtaposed to the first and second planar portions of the nock opening, respectively; and, the first and second curved portions of the connection member are juxtaposed to the first and second curved portions of the nock opening.

13. An alignment tool and nock assembly for use with an associated arrow, wherein:

the associated arrow comprises: (1) a body; and, (2) first, second and third vanes extending outwardly from the body at an angular orientation;

the alignment tool comprises:

a body having an outer surface;

a connection member extending from the body; and, first and second indicating surfaces that are spaced around the outer surface of the alignment tool body at a relative angular orientation that matches the angular orientation of the first and second vanes on the arrow body;

the nock assembly comprises:

a nock comprising: (1) a bowstring reception surface that is designed to receive an associated bowstring to fire the associated arrow; and, (2) an extension having a shape;

an insert comprising: (1) a connection surface that is connectable to the arrow body; and, (b) an opening having a shape;

the alignment tool and insert are rotatable with respect to the associated arrow when the insert is connected to the arrow body and the connection member is inserted into the opening in the insert to align the insert with respect to the arrow by aligning the first and second indicating surfaces with respect to the first and second vanes; and, wherein the nock extension is insertable into the opening of the aligned insert in a fixed number of relative positions based on the shape of the nock extension and the shape of the insert opening to align the nock with respect to the arrow.

14. The alignment tool and nock assembly of claim 13 wherein:

the opening in the insert comprises at least one planar portion and at least one curved portion;

the connection member has an outer surface comprising at least one planar portion and at least one curved portion;

the notch extension has an outer surface comprising at least one planar portion and at least one curved portion;

when the connection member is inserted into the insert opening: the at least one planar portion of the connection member is juxtaposed to the at least one planar portion of the insert opening; and, the at least one curved portion of the connection member is juxtaposed to the at least one curved portion of the insert opening; and, when the notch extension is inserted into the insert opening: the at least one planar portion of the notch extension is juxtaposed to the at least one planar portion of the insert opening; and, the at least one curved portion of the notch extension is juxtaposed to the at least one curved portion of the insert opening.

15. The alignment tool and nock assembly of claim 13 wherein:

the associated arrow body has an opening;

the insert comprises an extension defining the connection surface that is connectable to the arrow body by insertion of the insert extension into the arrow body opening;

the nock comprises an opening;

the nock assembly comprises an LED-battery combination component that: (1) is received in both the insert opening and the nock opening when the nock assembly is attached to the associated arrow; and, (2) lights the nock when activated; and, (3) is press fit within the nock opening so that when the nock is manually removed from the insert the LED-battery combination component remains with the nock.

16. The alignment tool and nock assembly of claim 13 wherein:

the nock comprises a head from with the nock extension extends;

the nock head comprises the bowstring reception surface the nock head remains outside the insert when the notch extension is inserted into the insert opening.

17. The alignment tool and nock assembly of claim 13 wherein: the outer surface of the alignment tool body extends inwardly between the first and second indicating surfaces.

18. The alignment tool and nock assembly of claim 13 wherein the first and second indicating surfaces are spaced substantially an equal distance from a longitudinal axis of the connection member.

19. The alignment tool and nock assembly of claim 13 wherein:

the associated arrow body has an outside diameter OD at a location where the insert is connected to the arrow body;

the first indicating surface is spaced a distance D1 from a longitudinal axis of the connection member;

the second indicating surface is spaced a distance D2 from the longitudinal axis of the connection member;

D1 is greater than OD; and,

D2 is greater than OD.

20. The alignment tool and nock assembly of claim 13 wherein:

the alignment tool comprises a third indicating surface that is spaced on the outer surface of the alignment tool body at a relative angular orientation that matches the angular orientation of the third vane on the arrow body; and, the alignment tool and insert are rotatable with respect to the associated arrow when the insert is connected to the arrow body and the connection member is inserted into the opening in the insert to align the insert with respect to the arrow by aligning the third indicating surface with respect to the third vane.

* * * * *